US011548010B2

(12) United States Patent
Valerio

(10) Patent No.: US 11,548,010 B2
(45) Date of Patent: Jan. 10, 2023

(54) FLUIDIZED INERTIA TABLE

(71) Applicant: Thomas A Valerio, Atlanta, GA (US)

(72) Inventor: Thomas A Valerio, Atlanta, GA (US)

(73) Assignee: TAV HOLDINGS, INC., Atlanta, GA (US)

( * ) Notice: Subject to any disclaimer, the term of this patent is extended or adjusted under 35 U.S.C. 154(b) by 0 days.

(21) Appl. No.: 17/055,928

(22) PCT Filed: May 16, 2019

(86) PCT No.: PCT/US2019/032753
§ 371 (c)(1),
(2) Date: Nov. 16, 2020

(87) PCT Pub. No.: WO2019/222558
PCT Pub. Date: Nov. 21, 2019

(65) Prior Publication Data

US 2021/0220835 A1 Jul. 22, 2021

Related U.S. Application Data

(60) Provisional application No. 62/672,543, filed on May 16, 2018.

(51) Int. Cl.

| | |
|---|---|
| ***B03B 4/02*** | (2006.01) |
| ***B03B 5/04*** | (2006.01) |
| ***B07B 13/11*** | (2006.01) |

(52) U.S. Cl.
CPC ..... *B03B 4/02* (2013.01); *B03B 5/04* (2013.01); *B07B 13/113* (2013.01)

(58) Field of Classification Search
CPC .... B03B 4/00; B03B 4/02; B03B 5/04; B07B 1/40; B07B 13/113; F15B 15/12; H03K 7/02; H03K 9/08; B25J 9/14
See application file for complete search history.

(56) References Cited

U.S. PATENT DOCUMENTS 3,916,704 A * 11/1975 Gaberson ..... F03G 3/00 74/84 R
4,304,662 A * 12/1981 Strauss ..... B03B 5/20 209/457
2005/0173308 A1* 8/2005 Kelsey ..... B03B 4/065 209/155

* cited by examiner

*Primary Examiner* — Michael McCullough
*Assistant Examiner* — Kalyanavenkateshware Kumar
(74) *Attorney, Agent, or Firm* — Greenberg Traurig LLP

(57) ABSTRACT

A fluidized inertia table for separating materials between an upstream delivery station and a downstream receiving station is provided. The fluidized inertia table for separating materials creates a moment of inertia and/or rotary motion which are then translated into reciprocating or jarring motions and separates the materials loaded onto the tray.

20 Claims, 10 Drawing Sheets

FLUIDIZED INERTIA TABLE

CROSS-REFERENCE TO RELATED APPLICATIONS

This application claims priority on U.S. Provisional Patent Application No. 62/672,543, filed on May 16, 2018, which is incorporated by reference herein in its entirety and for all purposes.

FIELD OF THE INVENTION

This application generally relates to a fluidized inertia system or separator (FIS). More particularly, the application relates to a system and method of separating materials using inertia or using a fluidized inertia table (a separation table) that uses a dynamic or changing moment of inertia to separate materials.

BACKGROUND OF THE INVENTION

A waste material mixture including relatively denser particles can be separated over a moving, separation surface. Such waste materials can flow with wash water to one portion of a concentrator apparatus, while the mineral concentrate is collected and moved to another part of the concentrator apparatus as a result of a relative densities and specific gravities. Water on the separation surface can help stratify and move the raw material along various flow paths.

Many apparatus and processes include conveying materials (items or objects or particles or substance) from a station to a second station. Many apparatuses and processes are used to separate materials and screen materials from waste or other material stream. Other systems shake materials and have perforations to size materials by, e.g., allowing materials of another size to fall through the perforations.

Further, sieves have been used to separate different fractions of either the same or different materials for a long time. By arranging the material which is to be separated on a mesh or a plate with apertures and vibrating the mesh plate or plate with apertures up and down, back and forth or a combination, material having a particle size less than the mesh opening or the aperture opening, will fall through the sieve and thereby be separated from the material.

Accordingly, there is always a need for an improved system or method of separating materials.

SUMMARY

This application disclosed a system and a method for separating materials containing valuable elements (e.g., metal). In one aspect, this application provides a Fluidized Inertia table for separating materials having a frame, a tray for loading and/or holding materials, a cam which is operatively connected to the tray or bed (e.g., below the tray), a motor coupled to the cam and a fluid dispensing system to create a fluidized bed. The cam is operatively connected to the tray and the motor coupled to the cam creates a dynamic or changing moment of inertia around the cam and/or rotary/tangential motion across the tray, which may be translated into reciprocating and/or linear motions that separate the materials loaded onto the tray by means of the effected rotational and translational motions.

A fluidized inertia table for separating materials, comprising: a frame; a tray for loading materials that is secured within the frame by a plurality of cylinders and springs; cams operatively connected to the tray; counterweights to balance to the tray by moving in equal and opposite direction, and a motor operatively connected to the cam, the motor is coupled to the cam and together which creates reciprocating motion, and the reciprocating motion separates materials loaded onto the tray, wherein the motor has a pulse width modulation; the motor, the cams, and the springs create a non-sinusoidal drive profile. The fluidized inertia table may have a horizontal fluid system or a vertical fluid system. The motor can rotate at between 6.7 to 10 hertz and have a period as such. The drive profile has a first part and a second part during a period, and the higher amplitude during the first part higher than the second part Another aspect provides a process for separating materials in which materials are accumulated on or conveyed by the tray or bed. The materials separate and move via the changing moment of inertia of the fluidized bed and/or the rotary and/or linear motion of the tray or bed caused by the reciprocating motion of the drive mechanism. As a result, heavier materials are carried forward and the lighter materials are carried backwards.

Another aspect includes a fluidized inertia table that separates the materials that are loaded on the tray though a changing or dynamic moment of inertia caused by reciprocating motion of the cam. As the material is separated, the cylinders (hydraulic cylinders) or springs compensate for the load or balance the tray and the table so that the table remains balanced.

Another aspect includes a fluidized inertia table with a horizontal and vertical fluid system to improve the separation of materials. Such a fluid system may include nozzles or jets that spray water or gas/air jets onto or into the materials. In one example, the use of water or fluid or media allows for a fluidized bed over the tray, which may improve the separations of particles.

Another aspect includes a fluidized inertia table with a tray that can be tilled or angled to improve the separation of materials on the tray. The tray may be angled or tilted with respect to the horizontal. The tilt or the angle of the tray may be varied to improve the separation of the material. The angle of the tray can be varied from 0 degrees to 30 degrees and may be continuously adjusted by a computer by driving the tilt actuators as the material is fed into the tray.

Another aspect includes a fluidized inertia table having a mat or bristle material that is placed on or affixed to the tray for improved separation of the materials. Larger or deeper patterns on the mat may be used to separate larger and heavier materials, whereas smaller or shallower patterns may be used to separate lighter materials.

Another aspect includes a fluidized inertia table that uses a fluidized inertia bed to spread and liberate and separate materials.

Other variations, embodiments and features of the present disclosure will become evident from the following detailed description, abstract and claims.

DETAILED DESCRIPTION

Figure 1:
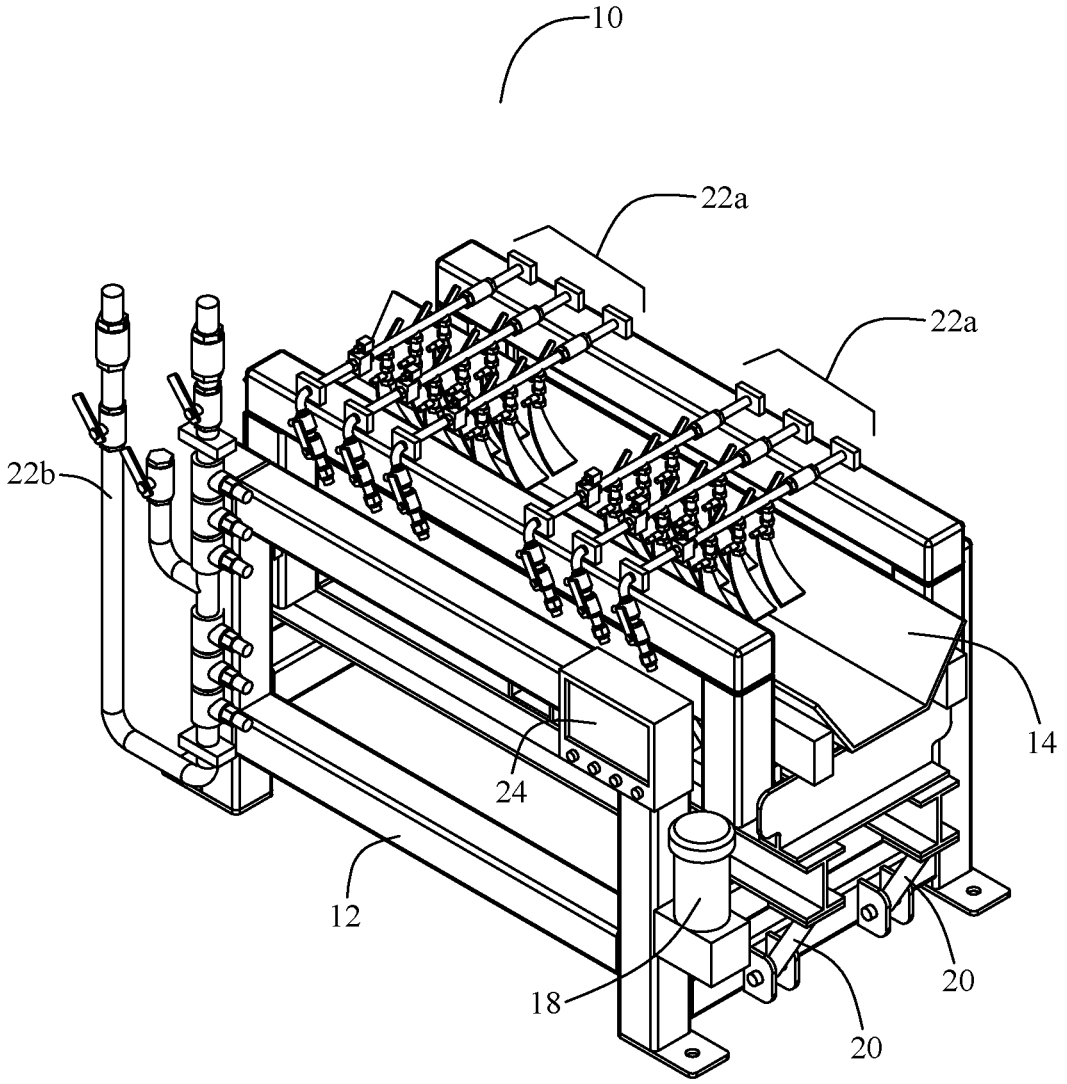
FIG. 1 shows a perspective view of a fluidized inertia table in accordance with one embodiment.
Figure 2:
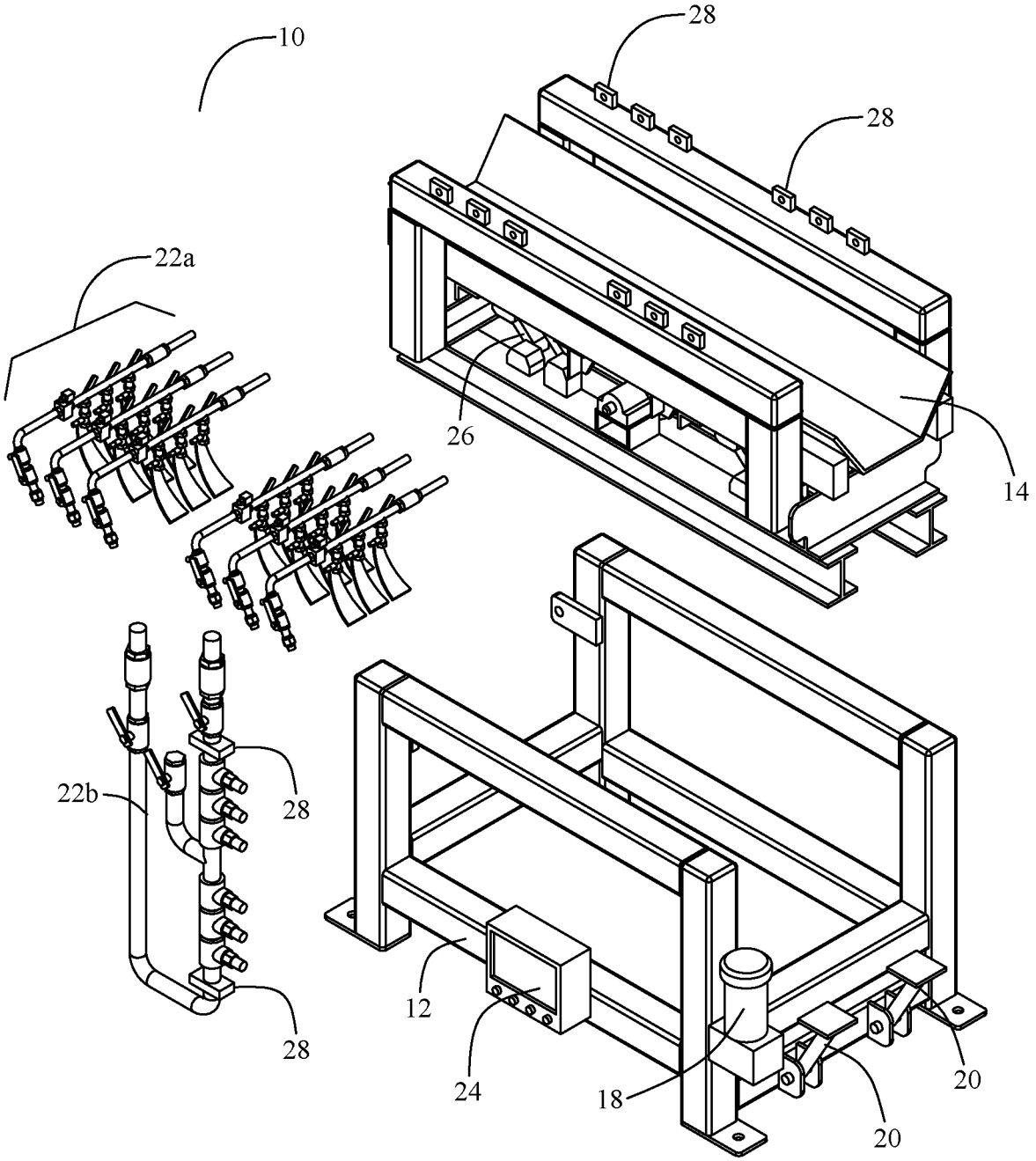
FIG. 2 shows an exploded perspective view of a fluidized inertia table in accordance with an embodiment.
Figure 3:
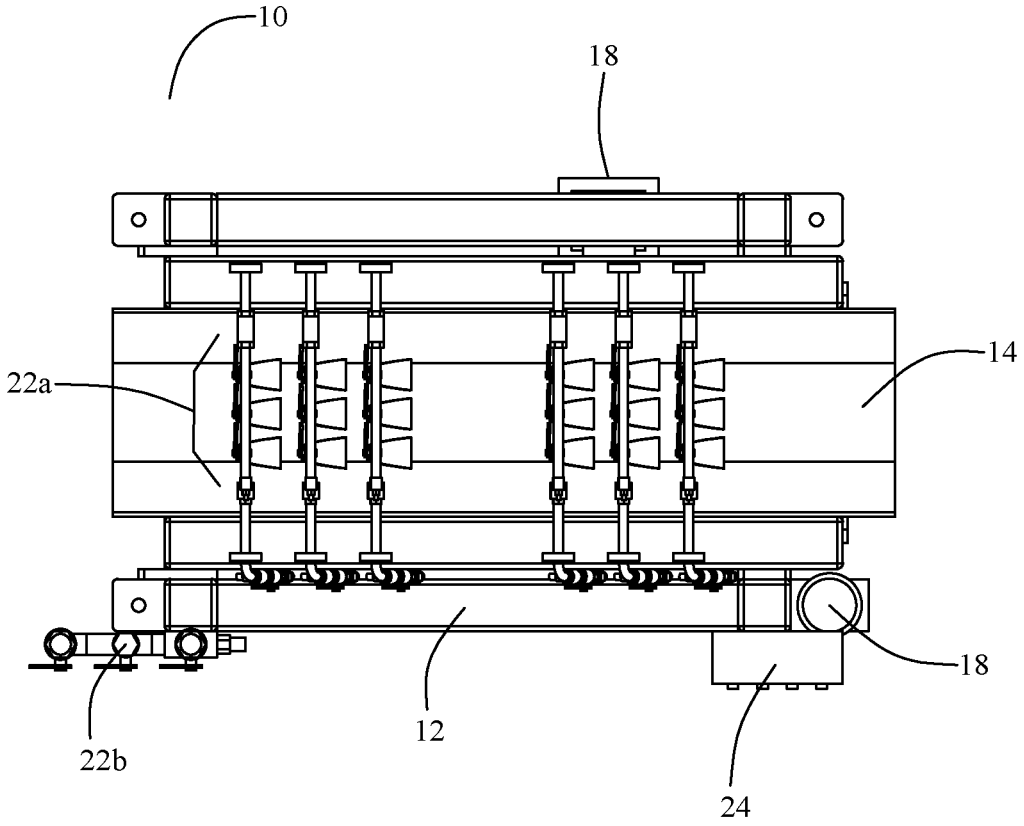
FIG. 3 shows a top view of a fluidized inertia table in accordance with an embodiment.
Figure 4:
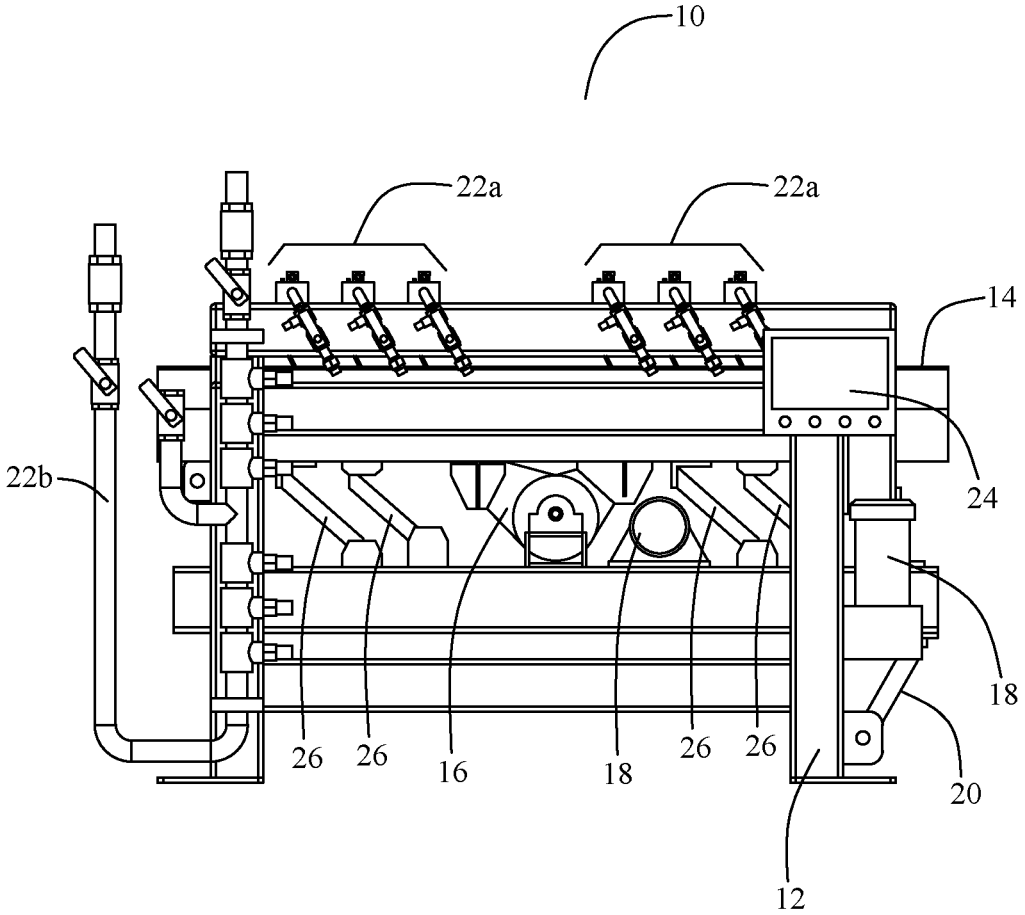
FIG. 4 shows a side view of a fluidized inertia table in accordance with an embodiment.

Specific embodiments will now be described more fully hereinafter with reference to the accompanying drawings in which embodiments are shown. This invention may, however, be embodied in many different forms and should not be construed as being limited to the embodiments set forth herein. Rather, the embodiments are provided so that this disclosure will be thorough, and will fully convey the scope of the application.

The term "materials" as used herein generally refers to any items or objects or particles or substances that need to be separated. Exemplary materials are generally from a waste stream or waste material These materials include bottom ash and fly ash, fly ash from incinerator exhaust and bottom ash from an incinerator, feeding the collected fly ash and bottom ash to a gasification/vitrification reactor, municipal solid waste (MSW), refuse-derived fuel (RDF), biomass, coal, hazardous waste, medical waste, liquid waste streams of coal or other carbonaceous products, or a combination of any such materials, vitrifying the ash, and any other inert constituents. In one example, the materials are fly ash, bottom ash, and additional feed material.

Embodiments provides a system and method of separating materials containing valuable elements (e.g., metal) between an upstream delivery station and a downstream receiving station. Referring now to FIG. 1, FIG. 2, FIG. 3 and FIG. 4, the table or FIS table for a separating material between an upstream delivery station and a downstream receiving station. A fluidized inertia table 10 may include a frame 12, a tray or tilt tray 14, a cam 16 and a plurality of motors 18. The tray 14 is secured within the frame 12 by means of plurality of cylinders 20 and springs 26. A cam 16 is fixed below the tray 14 and a motor 18 is coupled to the cam 16 which creates a changing moment of inertia in the non-stationary components via a rotary motion translated into reciprocating motion. Further, the changing moment of inertia and/or rotary motion translated into reciprocating motion developed by the motor 18 and the cam 16 separate the material loaded onto the tray 14. In its simpler form without being bound to any theory, the changing moment of inertia and/or rotary motion translates into a reciprocating or a jarring motion that shakes the materials so that the material loaded onto the tray 14 separates.

The fluidized inertia table 10 can be a continuous feed and discharge type. Preprocessed materials or raw material can be supplied to the fluidized inertia table 10. The motion with the media or water creates stratification and a movement to the materials from towards the ends based on specific gravity and density. The waster material may have been screened and classified.

In one embodiment, the balancing of the tray 14 is accomplished through plurality of the cylinders 20 and the springs 26, so to significantly reduce the transmission of vibratory forces from the fluidized inertia table 10 to the surrounding environment. The balancing includes the application of Newton's third law of motion (for every action there is an equal and opposite reaction). By moving one mass in the tray 14 in the opposite direction of another mass (an equally heavy balancing weight), there is a balance of the forces created by both masses. The material loaded on the tray 14 can be factored into the fluidized inertia table 10, and can be balanced through the springs 26.

In one embodiment, the tray 14 can be secured to (e.g., pneumatic) cylinders 20/springs 26/spring like element, which can be secured to the frame 12.

In one example, the cylinders 20 or springs 26 or spring like element can be used to balance the forces. As the material passes through the tray 14 and the reciprocating or jarring motion occurs, the cylinders 20 (e.g., four cylinders) compensate for the forces. For example, the fluidized inertia table 10 is balanced, in that the cylinders 20 compensate or react to the forces on the tray 14. Further, the fluidized inertia table 10 can be easily moved up and down as needed by the users. Also, the fluidized inertia table 10 can be easily locked and unlocked in various positions when loaded by locking the pinion or releasing the pinion. Further the fluidized inertia table 10 can be balanced so to minimize the vertical motion of the tray 14.

In one embodiment, the materials processed by the upstream delivery station are accumulated on or conveyed by the tray 14, which separates and moves material by creating a a dynamic or changing moment of inertia and/or rotary motion translated into reciprocating motion (e.g., a stroke/follower motion). As a result, heavier materials are carried forward and the lighter materials are carried backwards.

In some embodiments, it is understood that a larger or more powerful motor may be needed in some instances. In one example, a larger motor may be used to work with heavier material or a larger volume of material. A smaller motor may be optimal in applications where the material is looser and lighter.

In some embodiments, heavier or more durable springs may be used to improve the life of the fluidized inertia table 10. In one example, the spring 26 may be a high-quality fiberglass spring, e.g., manufactured by 3M.

In some embodiments, the size of the tray 14 may vary; accordingly, the size of the fluidized inertia table 10 varies. In one example the fluidized inertia table system is 60 inches.

In operation and use, the fluidized inertia table 10 can separate materials that are loaded on the tray 14 though a dynamic or changing moment of inertia or reciprocating motion of the cam 16. As the material is separated, the cylinders 20 (hydraulic cylinders) or springs 26 compensate for the load or balance the tray 14 and the fluidized inertia table 10 so that the fluidized inertia table remains balanced.

In another embodiment, the fluidized inertia table 10 is provided with horizontal and vertical fluid system 22*a*, 22*b* to improve the separation of materials by spraying water or gas/air jets to the materials. The use of water or fluid allows for a fluidized bed over the tray or tilt tray 14.

To improve the separation of materials, the tray 14 on the frame 12 may be angled or tilted (e.g., in real time) with respect to the horizontal through actuators. The tilt or the angle of the tray 14 may be varied to improve the separation of the material. The angle of the tray 14 can be varied from 0 degrees to 30 degrees and may be continuously adjusted by a computer 24 whereby adjusting the cylinders 20 as the material is fed into the tray 14. Again, the heavier material moves towards the front of the fluidized inertia table 10 and the lighter materials moves towards the back of the fluidized inertia table 10.

In another embodiment, to improve the separation of materials, water or gas/air jets may be used to spray the material. The sprays allow the material to be further separated by the a dynamic or changing moment of inertia and/or cam 16 motion of the tray 14. The use of water or fluid allows for a fluidized bed, which is more easily developed because the tray 14 is balanced.

In another embodiment, a mat or bristle material can be placed on the tray 14 for improved separation of the materials. Larger or deeper patterns on the mat may be used to separate larger and heavier materials, whereas smaller or shallower patterns may be used to separate lighter materials. More fluidization can be achieved with the addition of water, which can improve the separation of the material along the mat.

Figure 5A:
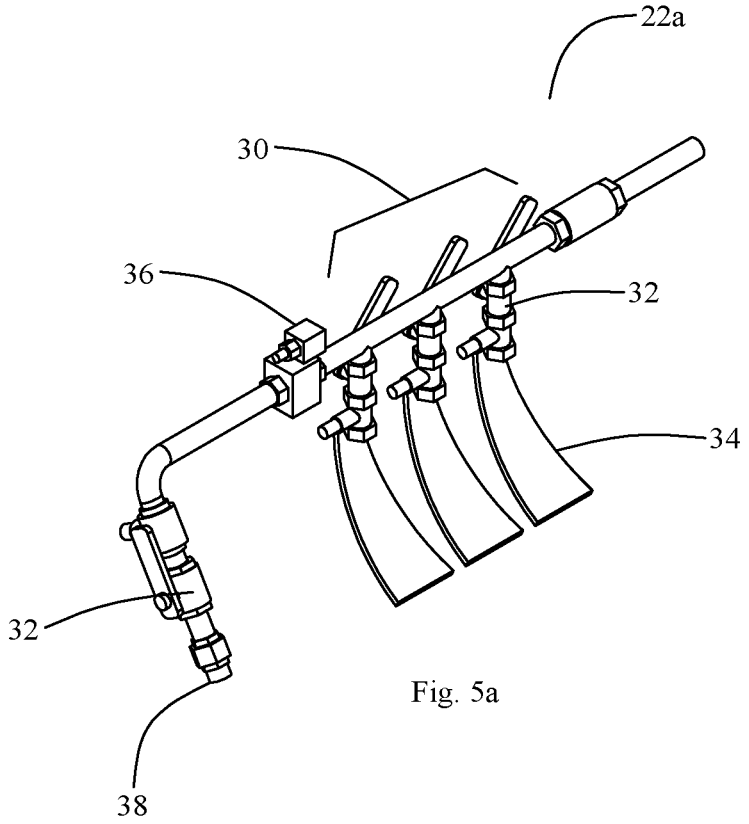
FIGS. 5*a* and 5*b* shows horizontal fluid system of the fluidized inertia table in accordance with an embodiment.
Figure 5B:
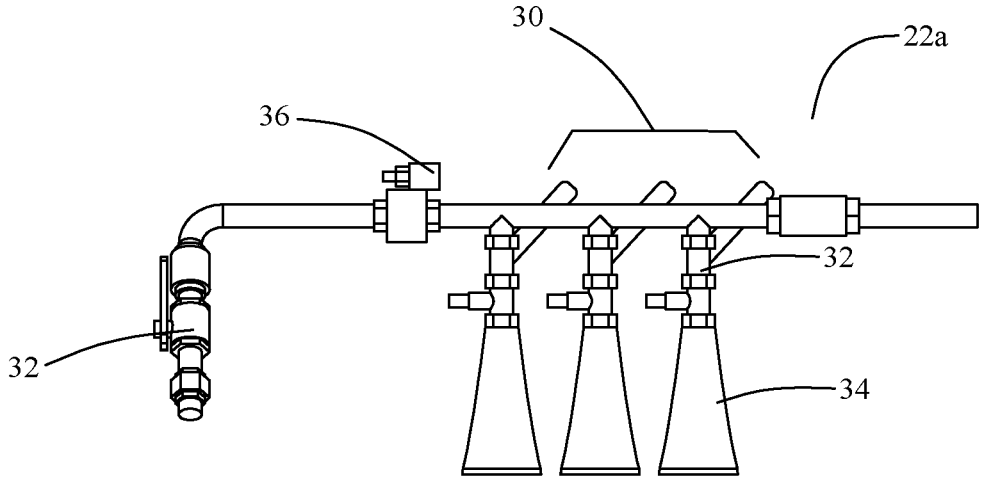

FIGS. 5*a* and 5*b* show the horizontal fluid system 22*a* of fluidized inertia table system 10 comprises a plurality of jet systems 30 formed by an arrangement of valves 32 and flaps 34. The FIS system consist of a balanced oscillating textured bed at variable angle to the gravitational pull and a variable thickness of water on the bed and water distribution points along the length and width of the bed with controlled water influx to maintain consistent conditions, river flow rates, bed thickness, separation effectiveness.

The horizontal fluid system 22*a* may be provided with electronic switches 36 controlled by the computer 24 to control the amount of fluid allowed to pass through the jet systems 30. The horizontal fluid system 22*a* is secured with the frame of the tray 14 by means of mounting blocks 28. An inlet 38 in the horizontal fluid system 22*a* is provided with a quick connect fitting such as, but not limited to like union, etc., to establish the connection with an outlet 40 of vertical fluid system 22*b*.

Figure 6A:
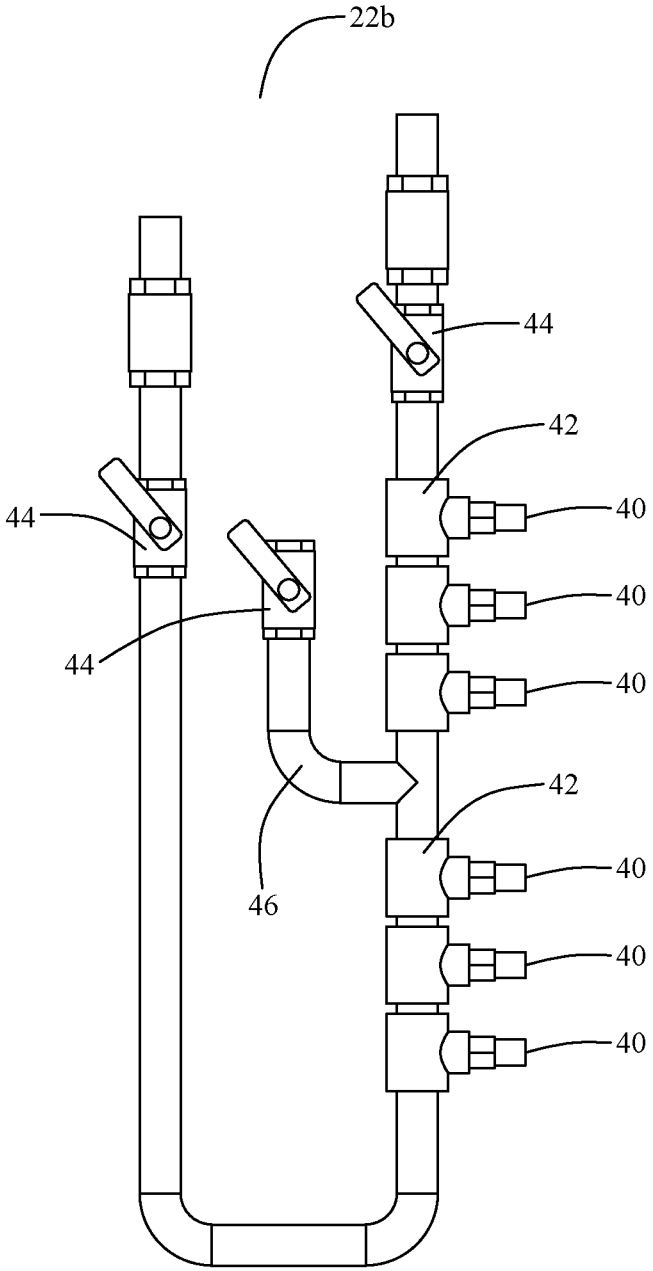
FIGS. 6*a* and 6*b* shows vertical fluid system of the fluidized inertia table in accordance with an embodiment.
Figure 6B:
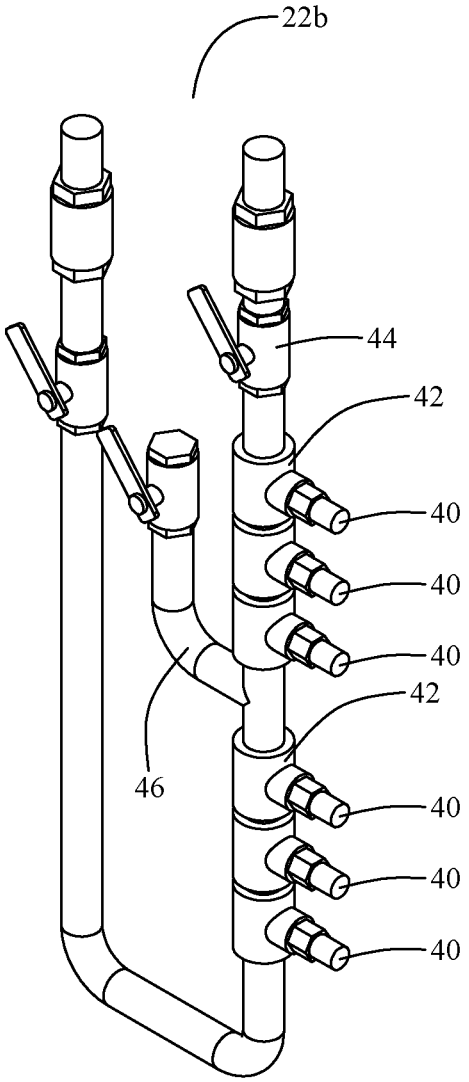

FIGS. 6*a* and 6*b* shows the vertical fluid system 22*a* of fluidized inertia table 10 is formed in a U-shape and comprises of plurality outlets 40 provided on one branch fitting 42 to establish the connection with the inlet 38 of the horizontal fluid system 22*a*. The vertical fluid system 22*a*, further have safety accessories like valves 44 and by-pass line 46.

Further in another embodiment, the computer 24 with a sensor can analyze the scan of any material entering the fluidized inertia table 10. The computer 24 further determines the need to adjust the tray 14, the sprays and the overall balance of the fluidized inertia table system 10. The computer 24 may determine, for example, that the material needs to be elevated or lowered relative to the horizontal and/or the material may require shifting laterally to one side or the other. The adjustable support of the fluidized inertia table 10 is arranged to accordingly adjust the position of the material on the tray 14.

Further in another embodiment, spraying air or water can be used on the material so to improve the separation of the material. Heavier materials or larger materials are pushed forward, whereas lighter or smaller materials are pushed backwards.

In some embodiment, the fluidized inertia table 10 can have a weighted frame isolated from the mounting surface by springs 26. The frame 12 can be heavier (e.g., four to ten times heavier) than the weight of the tray 14 above, and the heavier the base or frame, the greater the isolation it provides. During operation, this weighted lower frame runs 180 degrees out of phase with the transport surface, counteracting the forces generated above.

In some embodiments, the fluidized inertia table 10 has two separate and distinct masses, one designed to carry material and the other mass designed to offset dynamic loads that would normally go into a structure. These two masses normally run 180 degrees out of phase so that they cancel forces or minimize forces.

One embodiment of the fluidized inertia table 10 can be installed on elevated support steel, on large floor spans, upper stories, on soft ground, areas with a high water table, and other soft areas.

In another embodiment of the fluidized inertia table 10 employs a counterpoise frame equal to the tray 14 or trough weight supported on the frame 12 by duplicate trough reactor assemblies. This arrangement is positively driven 180 degrees out of phase with the tray 14. Alternatively, or additionally, the frame 12 may be mounted on a floating spring.

Yet in another embodiment, the fluidized inertia table 10 may be used (e.g., unbalanced) if a mounting structure or significant footing is available.

Another embodiment includes a method for separating materials including providing the materials on a bed capable of creating a changing or dynamic moment of inertia, exposing the materials to a changing or dynamic moment of inertia so to liberate and separate the materials, and collecting the heaving materials at a first end of the bed and collecting the lighter materials at a second end of the bed.

In another embodiment, the system uses a fluidized inertia bed to spread and liberate material.

In another embodiment, the system can be a balanced system using counterweights and create relatively large radial spring forces to overcome/compensate and/or enhance the dynamic or changing moment of inertia about the large arc axis produced by the spring linkage. The forces allow the system to oscillate the bed and create with substantially higher accelerations of the particles in the bed, which thrust the higher SG particles and/or larger particles much further through the liquid, allowing them to travel upstream to the "heavies" end of the system. The lower SG materials can work their way downstream toward the "lights" end of the system. A moment of inertia a quantity expressing a mass' tendency to resist angular acceleration, which derives (in part) from the bed.

As shown, FIGS. 7*a*, 7*b*, 8*a*, 8*b*, 9*a* and 9*b* illustrate the power curves for a simplified system and reflect a few of the differences in acceleration potential that can be achieved. The power at any moment directly correlates to the acceleration that will be seen at that moment. The graphs indicate that the momentum of the bed will be larger after passing the extreme ends of the oscillations.

Figure 7A:
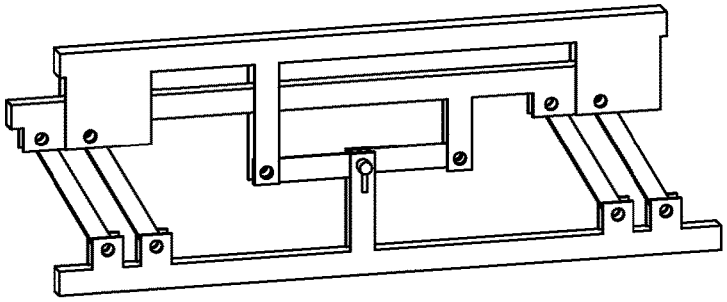
FIGS. 7*a* and 7*b* show power curves of the fluidized inertia table system at ideal condition in accordance with an embodiment.
Figure 7B:
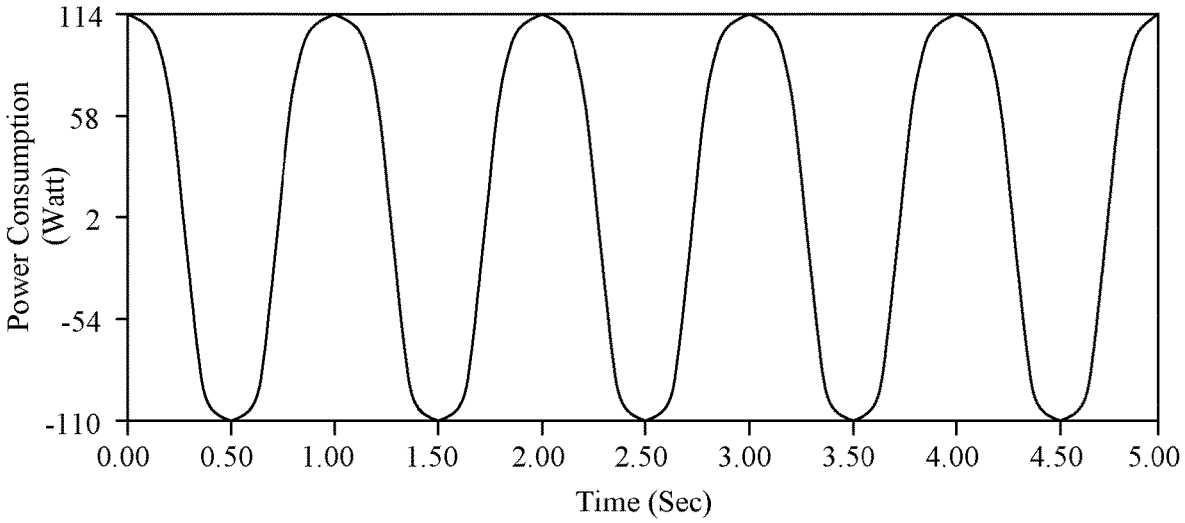

In another embodiment FIGS. 7*a* and 7*b* show power curves of fluidized inertiaing table 10 at ideal condition. It is observed that at ideal condition the power curves will follow traditional sine curves thus indicating the system is stable.

Figure 8A:
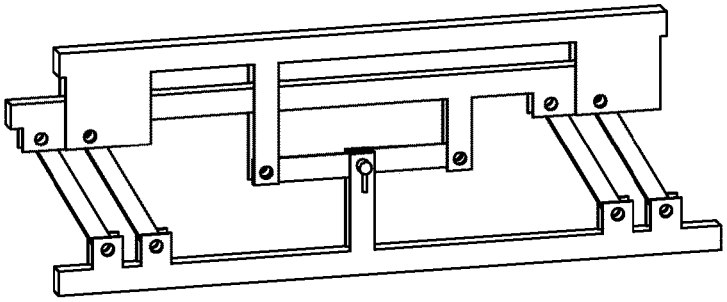
FIGS. 8*a* and 8*b* shows power curves of the fluidized inertia table system with a spring rate of 3000 inches×lbs/degree deflection condition in accordance with an embodiment.
Figure 8B:
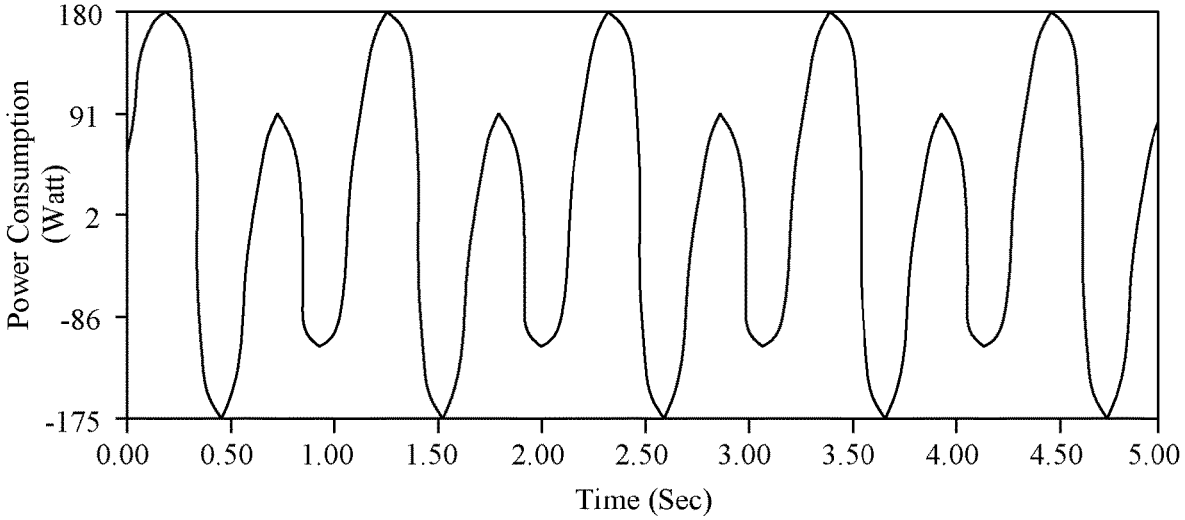

In another embodiment FIGS. 8*a* and 8*b* show power curves of table system 10 at 3000 inches*lbs/degree deflection condition. Again, it is observed that at such condition the power curve will follow symmetry and repeat itself after a set interval of time thus indicating the system is stable.

Figure 9A:
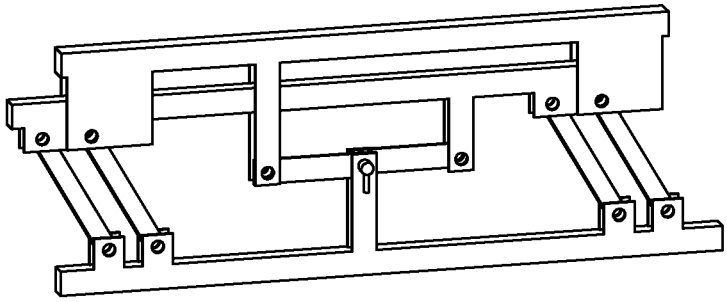
FIGS. 9*a* and 9*b* shows power curves of fluidized inertia table system with a spring rate of 9000 inches×lbs/degree deflection condition in accordance with an embodiment.
Figure 9B:
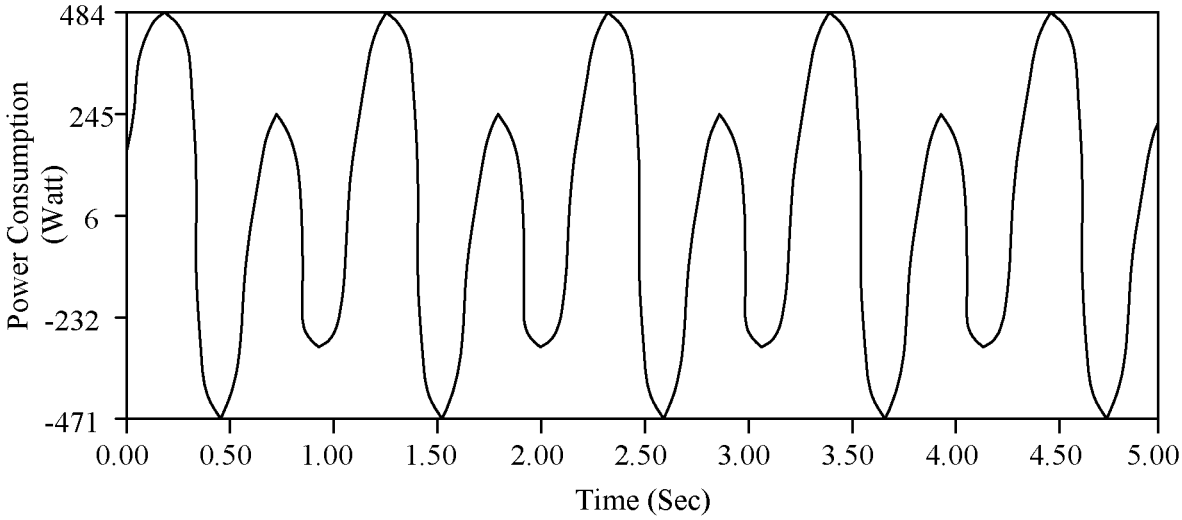

In another embodiment FIGS. 9*a* and 9*b* show power curves of fluidized inertia table system at 9000 inches*lbs/degree deflection condition. Again, it is observed that at such condition the power curve will follow symmetry and repeat itself after a set interval of time thus indicating the system is stable.

Figure 10:
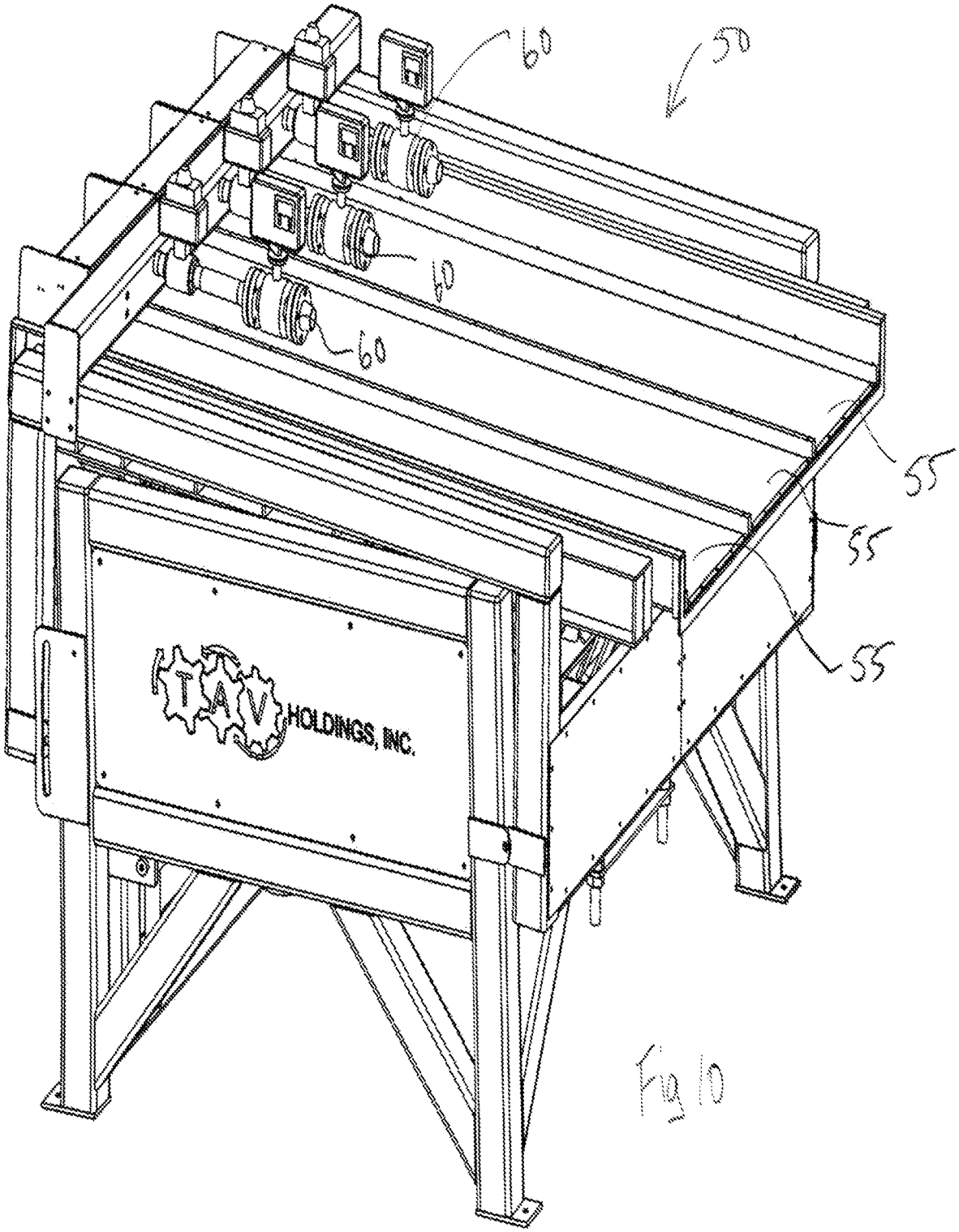
FIG. 10 shows another embodiment of the fluidized inertia table system with multiple lanes.

FIG. 10 shows another embodiment of the fluidized inertia table system 50 having lanes 55. The lanes 55 each can have dedicated flow meters 60 and water in feed across the lanes 55. This allows for an even and distributed fluidized bed.

Further the table can use screw jack(s) or hydraulic jack(s) or other tilting mechanism to adjust the tilt of the bed and can use a lock-down method to secure the bed system to a particular angle setting. The FIS that has adjustable tilt/angle mechanism will consist of a mobile portion of the system that tilts or pivots about a set of pins and a stationary base frame.

The oscillating bed can secured onto a mobile (tilting) frame that contains a pivot point on one end and jacking mechanism mount(s) on the other end.

In another embodiment, the system utilizes 2 machine screw jacks, one at each corner of the "heavies" discharge end, that contain a shaft between the jacks with an electric motor & gearbox assembly mounted on the shaft and the base frame assembly. The electric motor drives both jacks as a synchronized unit to obtain desired angles of the bed of the machine.

Further several sensors, typically inductive sensors are used to set end-of-travel limits while others are used to determine if the locking mechanisms are disengaged to allow movement.

In another embodiment, large jacks are employed and structures are built stout to allow the locking mechanisms to hold the frames secure while the jacks can overpower the lock-down mechanisms and adjust the angle/tilt of the machine without additional lock-down sensors. In some uses, the quality of the liquid distribution system to the bed can determine the efficiency and quality of separation, thus affecting the performance of the machine in various aspects.

In another embodiment, the system is setup with manual valve(s) to control the flow rates and another embodiment uses automated valves with electronic flow meters and a process controller or PLC to control the flow rates more precisely.

Further Process controllers can be setup with numerous algorithms to control the valves to achieve desired flow rates that counteract other external effects like incoming pressure variations and/or contaminates/particles in the liquid that catch or build-up on/inside the control valves.

Liquid medium can be distributed in various ways in order to obtain best separation. Primary liquid is added near the "top" or "heavies" end of the bed. Additional liquid can be added near or with the incoming material stream. Liquid can also be added near the "bottom" or "lights" discharge end of the bed.

In another embodiment, the primary liquid delivery onto the bed (at the top) is an evenly distributed gentle flow of water that allows materials to more easily pass across the liquid at the infeed point, so-as not to form a substantial bed of incoming raw materials that may overpower the flow of water and hinder separation.

In another embodiment, the primary liquid delivery onto the bed (at the top) is an evenly distributed gentle flow of water that allows materials to pass across the liquid in feed point easier, so-as not to form a substantial bed of incoming raw materials.

In one embodiment, the bed of the FIS system is relatively wide to allow much more material to be separated, typically unitized as TPH. In that embodiment, the bed contains ribs divide the bed into individual lanes.

Each lane is fed with liquid to allow individual separation parameters (flow rates of liquid). This can allow higher flow rates of material into a lane to be setup with higher flow rates of water to handle the incoming material stream, or to allow multiple gradations of material to be fed onto the same FIS system to separate multiple sizes or qualities of incoming materials to be separated.

At the discharge ends of the FIS or systems including an FIS, dewatering methods like vibratory screens or dewatering screw augers can be used to further prepare the separated products for further use or management.

The fluidized inertia table can oscillate using precision timed servo motors on both the bed and the counterweight or it can utilize mechanical linkage to maintain timing of the bed and counterweight. In one embodiment, there is a single motor with belts and pulleys that drive a dual cam shaft that is mounted on bearings affixed to the mobile/tilting frame assembly. The dual cam utilizes cylindrical offset cams. The offset cams are 180 degrees apart and determine the timing of the counterbalance. The amplitude of each offset is critical and must be coordinated with the weight of the bed and counterweight to provide precise balancing effects. For instance, the amplitude of both cams can be equal and opposite, and the weight of the counterweight must be near the weight of the bed in order to provide adequate balancing effect. In another embodiment, the amplitude of the counterweight side of the cam can be twice the amplitude of the bed side of the cam, and the weight of the counterweight can be reduced to half of the bed weight.

As can be seen, the tray or bed and counterweights are allowed to pivot using a 4-bar mechanism. In one embodiment, the linkages can be fiberglass springs that are clamped to the mobile frame and the respective bed or counterweight. In another embodiment, the linkages can be rigid arms with pivot points at each end and the bed, counterweight, and mobile frame mechanisms have mating pivot points and the bed and counterweight have coil springs that are rigidly attached at both ends to the mobile frame and the respective bed or counterweight. The higher the spring force, the higher the change in moment of inertia can be at various points in the rotation of the drive system. The spring forces will "overdrive" the drive system, enhancing the inertial acceleration and causing substantially greater momentum of the bed and consequently the material/particles.

Another embodiment includes a method for separating materials that includes providing the materials on a bed capable of oscillation and creating forces, wherein the bed includes media or water, exposing the materials to the forces so to overcome a moment of inertia of the materials so to liberate and separate the materials by specific gravity or size, and collecting the heavier materials at a first end of the bed and collecting the lighter materials at a second end of the bed. The bed can be on a frame that can be angled or tilted with respect to horizontal for improving the separation of materials. In some case, the bed can be angled or varied from 0 degrees to 30 degrees on the frame in real time. In some cases, heavier material moves towards the front of the fluidized inertia table and the lighter materials moves towards the back of the fluidized inertia table. The method may include using a fluid system, wherein the fluid system includes a horizontal fluid system and a vertical fluid system for spraying water or gas/air jets to the materials. The method can include spraying water or gas/air jets to the materials improves the separation of materials. The bed may have a mat or bristle material thereon for improved separation of the materials.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention without departing from the scope of the invention. The embodiments were chosen and described in order to explain the principles of the invention and its practical application to enable one skilled in the art to utilize the invention in various embodiments and with various modifications as are suited to the particular use contemplated.

The invention claimed is:

1. A fluidized inertia table for separating materials, comprising:

a frame;

a tray for loading materials that is secured within the frame by a plurality of cylinders and springs;

cams operatively connected to the tray; counterweights to balance to the tray by moving in equal and opposite direction, and a motor operatively connected to the cams, the motor is coupled to the cams and together which creates reciprocating motion, and the reciprocating motion separates materials loaded onto the tray, wherein the motor has a pulse width modulation; the motor, the cams, and the springs create a non-sinusoidal drive profile, whereby heavier material moves towards the front of the fluidized inertia table and the lighter materials moves towards the back of the fluidized inertia table.

2. The fluidized inertia table of claim 1, further comprising a horizontal fluid system or a vertical fluid system.

3. The fluidized inertia table of claim 2, wherein the horizontal fluid system is for spraying water, media or gas onto to the materials.

4. The fluidized inertia table of claim 2, wherein the vertical fluid system is for spraying water, media or gas onto the materials.

5. The fluidized inertia table of claim 4, further configured with a fluidized inertia bed to spread as well as liberate the materials.

6. The fluidized inertia table of claim 5, wherein the fluidized inertia bed has multiple lanes and jets therein.

7. The table of claim 1, wherein the motor rotates at between 6.7 to 10 hertz.

8. The table of claim 1, wherein the drive profile has a first part and a second part during a period, wherein the first part has a higher amplitude than the second part.

9. The fluidized inertia table of claim 1, wherein the tray on the frame is further angled or tilted with respect to horizontal for improving the separation of materials.

10. The fluidized inertia table of claim 1, wherein the angle of the tray is varied from 0 degrees to 30 degrees on the frame.

11. The fluidized inertia table of claim 1, wherein the tray is balanced by the cylinders and the springs, and reduces a transmission of vibratory forces to surrounding environment.

12. The fluidized inertia table of claim 1, further comprising a computer for adjusting angle of the tray by adjusting the cylinders as the material is fed into the tray, wherein the computer analyzes and scans of any material entering the fluidized inertia table.

13. The fluidized inertia table of claim 1, further comprises a mat or bristle material is placed on the tray for improved separation of the materials.

14. A method for separating materials comprising: providing the materials on a bed capable of oscillation and creating forces, wherein the bed includes media or water and acceleration and deceleration have a non-sinusoidal profile, exposing the materials to the forces so to overcome a moment of inertia of the materials so to liberate and separate the materials by specific gravity or size, and collecting the heavier materials at a first end of the bed and collecting the lighter materials at a second end of the bed.

15. The method of claim 14, wherein the bed is on a frame that can be angled or tilted with respect to horizontal for improving the separation of materials.

16. The method of claim 14, wherein the angle of the tray is varied from 0 degrees to 30 degrees on the frame.

17. The method of claim 14, where heavier material moves towards the front of the fluidized inertia table and the lighter materials moves towards the back of the fluidized inertia table.

18. The method of claim 14, further comprising using a fluid system, wherein the fluid system includes a horizontal fluid system and a vertical fluid system for spraying water or gas/air jets to the materials.

19. The method of claim 14, wherein spraying water or gas/air jets to the materials improves the separation of materials.

20. The method of claim 14, wherein the bed comprises a mat or bristle material thereon for improved separation of the materials.

* * * * *